US006810607B2

(12) United States Patent
Skrivan et al.

(10) Patent No.: US 6,810,607 B2
(45) Date of Patent: Nov. 2, 2004

(54) ANTI-BALLING SYSTEM

(75) Inventors: Joseph Skrivan, Draper, UT (US); Charles Brainerd, Draper, UT (US); Andrew McLean, Park City, UT (US)

(73) Assignee: Black Diamond Equipment, Ltd. Inc., Salt Lake City, UT (US)

( * ) Notice: Subject to any disclaimer, the term of this patent is extended or adjusted under 35 U.S.C. 154(b) by 0 days.

(21) Appl. No.: 10/344,047

(22) PCT Filed: Aug. 9, 2001

(86) PCT No.: PCT/US01/24979

§ 371 (c)(1),
(2), (4) Date: Aug. 15, 2003

(87) PCT Pub. No.: WO02/13643

PCT Pub. Date: Feb. 21, 2002

(65) Prior Publication Data

US 2004/0016145 A1 Jan. 29, 2004

Related U.S. Application Data

(60) Provisional application No. 60/224,400, filed on Aug. 10, 2000.

(51) Int. Cl.[7] ..... A43C 15/00; A43C 15/02; A43C 15/06

(52) U.S. Cl. ..... 36/59 R; 36/62; 36/64; 36/66

(58) Field of Search ..... 36/59 R, 61, 62, 36/64, 59 D, 66, 116

(56) References Cited

U.S. PATENT DOCUMENTS

| | | | |
|---|---|---|---|
| 2,776,499 | A | 1/1957 | Giuntini |
| 4,302,890 | A | 12/1981 | Covell et al. |
| 4,620,375 | A | 11/1986 | Wallace |
| 5,901,471 | A | 5/1999 | Warner |
| 6,163,984 | A | 12/2000 | Faber et al. |

*Primary Examiner*—Anthony Stashick
(74) *Attorney, Agent, or Firm*—Thorpe, North & Western

(57) ABSTRACT

An anti-balling system for a crampon (10) to prevent balling and snow accumulation during snow and ice climbing includes a plate (46, 50) attached to the bottom of the crampon. The plate can be rigid and can have a lower surface (54, 58) formed of a material configured to prevent sticking of snow or ice to the lower surface of the plate. The plate can include at least one loop (62) integrally formed at a front of the plate to receive a front point (38) of the crampon. The plate can have a loop or window (96 or 232) to receive the center strap (22 or 220) of the crampon. The plate can be attached with bail ends (222 and 224) of a bail (214). The lower surface of the plate can include a plurality of protrusions (100) extending therefrom forming a plurality of raised section (104) and a plurality of edges (108) forming a nonskid surface configured to prevent the lower surface of the plate from sliding with respect to another object.

23 Claims, 5 Drawing Sheets

ANTI-BALLING SYSTEM

This application is a 371 of PCT/US01/24979 filed Aug. 9, 2001 which claims benefit of U.S. application 60/224,400 filed Aug. 10, 2000.

BACKGROUND OF THE INVENTION

1. The Field of the Invention

The present invention relates generally to crampons for snow and ice climbing. More particularly, the present invention relates to an anti-balling system to prevent the balling or packing of snow accumulation under the crampons.

2. The Background Art

Crampons are typically used for snow and ice climbing. Crampons attach to a climber's boots and provide a number of elongated teeth to improve the climber's grip or footing on snow and ice.

Crampons are typically available in three styles, including hinged, semi-rigid or rigid. Hinged crampons are typically used for snow fields and glaciers; semi-rigid crampons are typically used for alpine climbs with periodic vertical ice; and rigid crampons are typically used for vertical ice. Crampons are typically constructed with horizontal or vertical frames. Horizontally oriented frames are flat and are typically used for snow climbing because they are more easily flexed for walking. Vertically oriented frames are stiffer. Crampons typically attach on in three ways, including strap-on, step-in, or a combination of the two. The strap-on system typically includes a forefoot strap that wraps around the forefoot, and an ankle strap that wraps around the ankle. The step-in system typically includes a wire toe bail that best engages a notch on the toe, or fits over a boot welt, and a heel bail with a tension lever that also best engages a notch on the heel, or that snaps into place on a heel welt.

As indicated above, crampons typically have a number of points or teeth which extend from the frame. Most of the points extend downwardly, while it is common to have two front points which extend downwardly and forwardly.

Although crampons improve traction while climbing on snow and ice, one common problem or disadvantage is the balling or accumulation of snow under the crampons and between the points. It will be appreciated that the build up of snow under the crampon and between the points renders the crampons useless.

One solution to the problem of snowballing is the use of latex or rubber members that are clipped to the underside of the crampons with clips. The clips are typically molded into the latex or rubber members. Thus, the latex or rubber members must be stretched to attach the clips around the crampon. One disadvantage with such clips is the difficulty in attaching the latex or rubber members to the crampons. Another disadvantage with such latex or rubber members is that they deform and come off easily. Another disadvantage with such clips is the expense and difficulty of manufacture due to attaching or molding the clips into the members.

SUMMARY OF THE INVENTION

It has been recognized that it would be advantageous to develop a system for preventing balling or snow accumulation under a crampon and between the points of a crampon. In addition, it has been recognized that it would be advantageous to develop an anti-balling system that is easier to use, and easier to attach to the crampons. In addition, it has been recognized that it would be advantageous to develop such an anti-balling system which also prevents skidding or sliding.

The invention provides an anti-balling system used with a crampon to prevent balling and snow accumulation during snow and ice climbing. The anti-balling system of the present invention advantageously includes a plate attached to the bottom of the crampon. The plate advantageously has a lower surface formed of a rigid material, such as a thermoplastic material, configured to prevent sticking of snow or ice to the lower surface of the plate, and thus to the crampon. The plate may be a single plate extending over the entire crampon, or may include front and rear plates extending over front and rear rails, respectively.

In accordance with one aspect of the present invention, the anti-balling system or plate advantageously utilized the structure of the crampon itself to secure the plate to the crampon.

In accordance with another aspect of the present invention, the plate may include at least one loop integrally formed at a front of the plate configured to receive a front point of the crampon to attach the plate to the crampon.

In accordance with another aspect of the present invention, the plate can be attached to the crampon with ends of the bails. The plate can be secured between the ends of the bails, and the crampon. In addition, the plate can have apertures to receive the ends of the bails.

In accordance with another aspect of the present invention, the plate can be attached to the crampon with a center strap that connects front and rear rails of the crampon. The plate can have a loop which receives the strap therethrough.

In accordance with another aspect of the present invention, the lower surface of the plate may include a plurality of protrusions extending therefrom forming a plurality of raised sections and a plurality of edges which form a nonskid surface configured to prevent the lower surface of the plate from sliding with respect to another object.

In accordance with another aspect of the present invention, the plurality of raised sections may be formed of a thermoplastic elastomer or urethane material, different from the thermoplastic material of the plate, further forming a nonskid surface configured to prevent the lower surface of the plate from sliding with respect to another object.

In accordance with another aspect of the present invention, the plate is configured to be removably attachable to the crampon.

A method for attaching an anti-balling plate to a crampon includes positioning the plate at the bottom of the crampon and sliding the at least one front point of the crampon through the at least one loop of the plate to secure the front of the plate to the front of the crampon. The apertures of the plate are aligned with the apertures of the side points. The sides of the plate are secured to the sides of the crampon by inserting fasteners through the apertures in the side points and the apertures in the points. The plate may be removed from the crampon by removing the fasteners and sliding the front point back out of the loop.

In addition, a method for attaching an anti-balling plate to a crampon includes positioning the plate at the bottom of the crampon and securing the plate using the bails of the crampon. For example, the ends of the bails can be pulled away from the crampon to allow the plate to be positioned against the bottom of the crampon, and then the bails can be released so that the plate is secured between the ends of the bails and the crampon. The ends of the bails can be received in apertures in the plate. In addition, the center strap connecting front and rear rails of the crampon can be inserted through the loop on the plate to further secure the plate to the crampon.

Additional features and advantages of the invention will be apparent from the detailed description which follows, taken in conjunction with the accompanying drawings, which together illustrate, by way of example, features of the invention.

DETAILED DESCRIPTION

Figure 1:
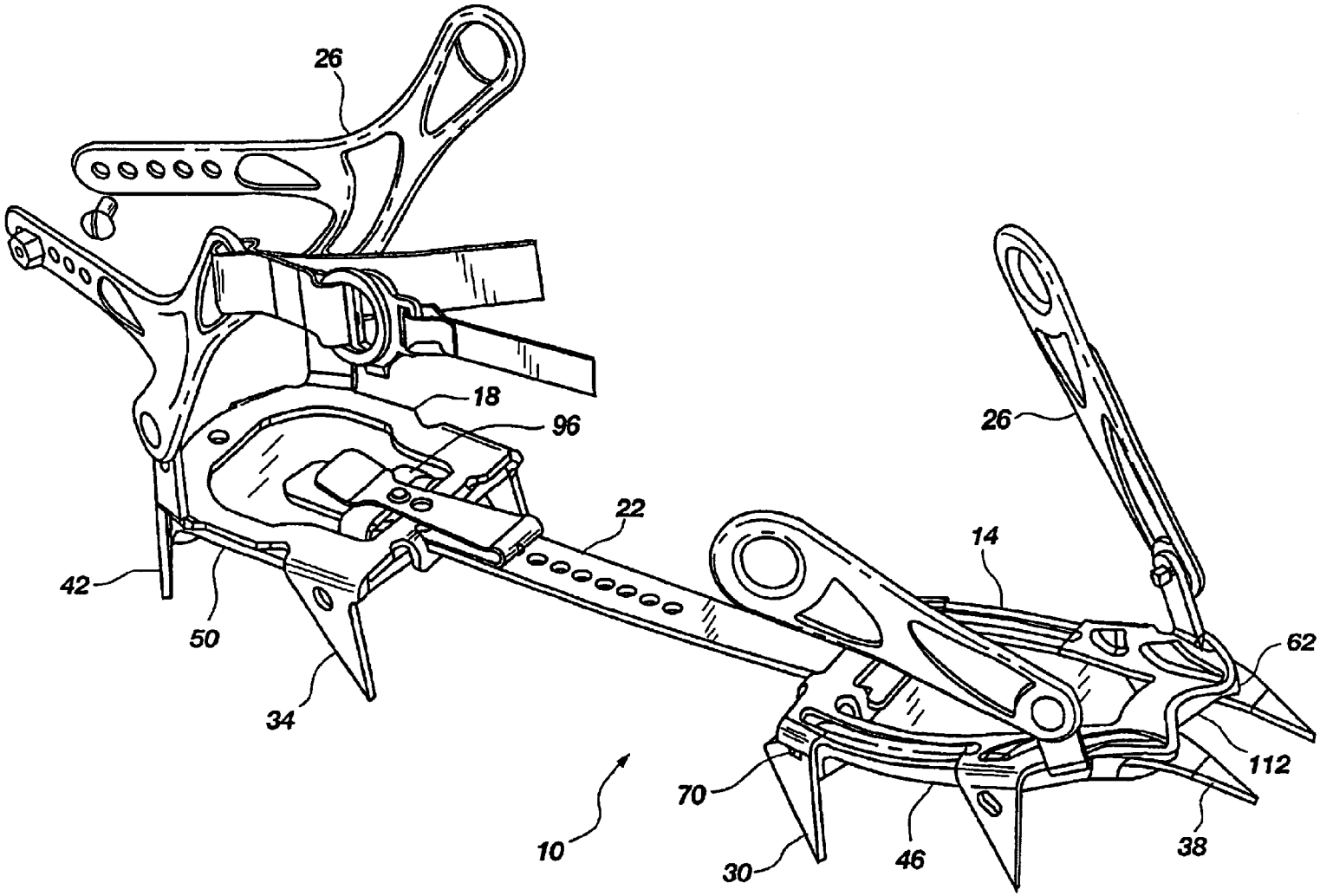
FIG. 1 is a top perspective view of anti-balling plates attached to a crampon in accordance with the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

As illustrated in FIG. 1, a crampon indicated generally at 10 forms a portion of the anti-balling system in accordance with the present invention. The crampon 10 illustrated is an example of a crampon which may be used with the anti-balling system of the present invention. It is, of course, understood that any type or configuration of crampon may be used with the anti-balling system of the present invention. The crampon 10 may include front and rear rails 14 and 18 connected by a center strap 22, such that the front and rear rails 14 and 18 are adjustable longitudinally about the center strap 22. It is, of course, understood that the front and rear rails 14 and 18 may form a single unitary rail or frame. A number of straps 26 are attached to the front and rear rails 14 and 18 for attaching the crampon 10 to a climber's boot (not shown). Each rail 14 and 18 has a number of points or teeth 30 which extend outwardly from the rails 14 and 18 or frame. The points include side points 34 located along the sides of the crampon 10, and a pair of front points 38 disposed on the front of the frame or front of the front rail 14. The crampon 10 may also include rear points 42. The side and rear points 34 and 42 typically extend vertically downwardly, while the front points 38 typically extend forwardly and downwardly at an angle.

Figure 2:
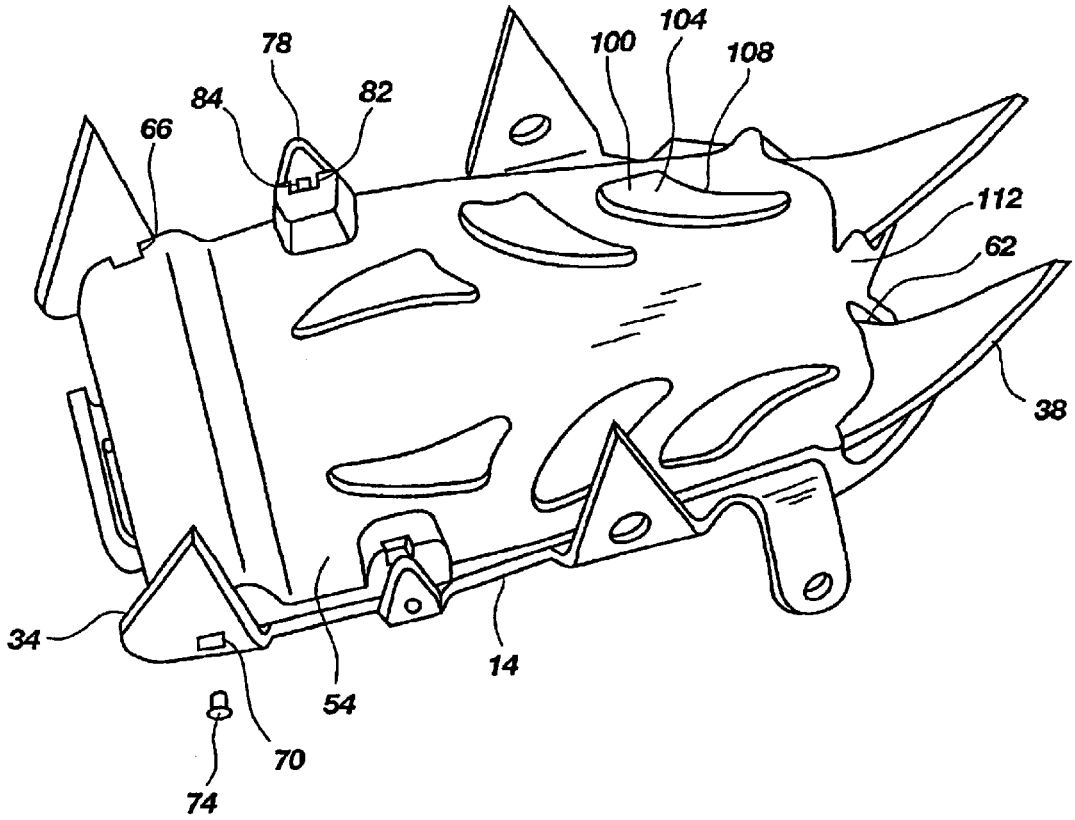
FIG. 2 is a bottom perspective view of the anti-balling plate attached to a front rail of the crampon of FIG. 1.
Figure 3:
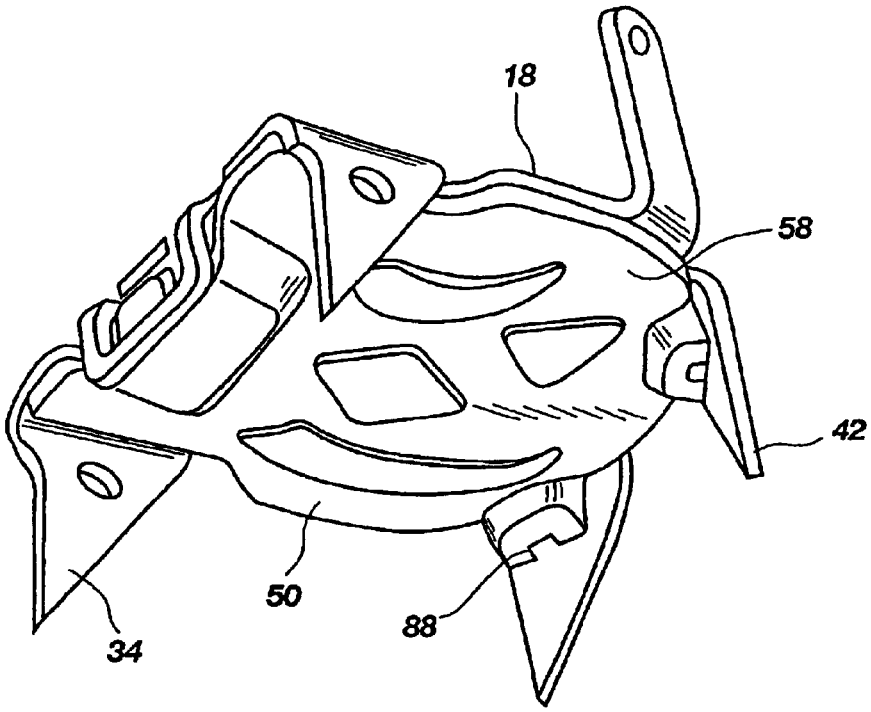
FIGS. 3 and 4 are bottom perspective views of the anti-balling plate attached to a rear rail of a crampon of FIG. 1.
Figure 4:
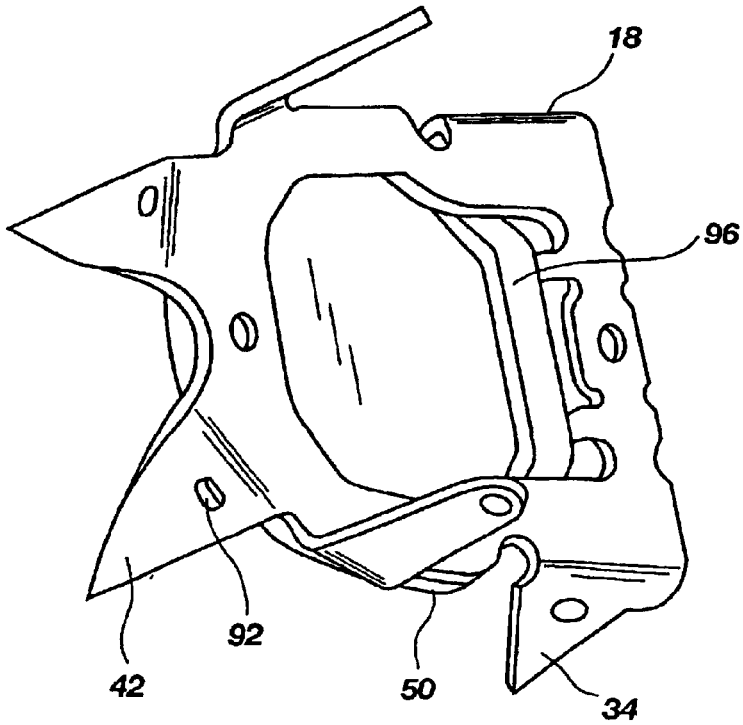
Figure 5:
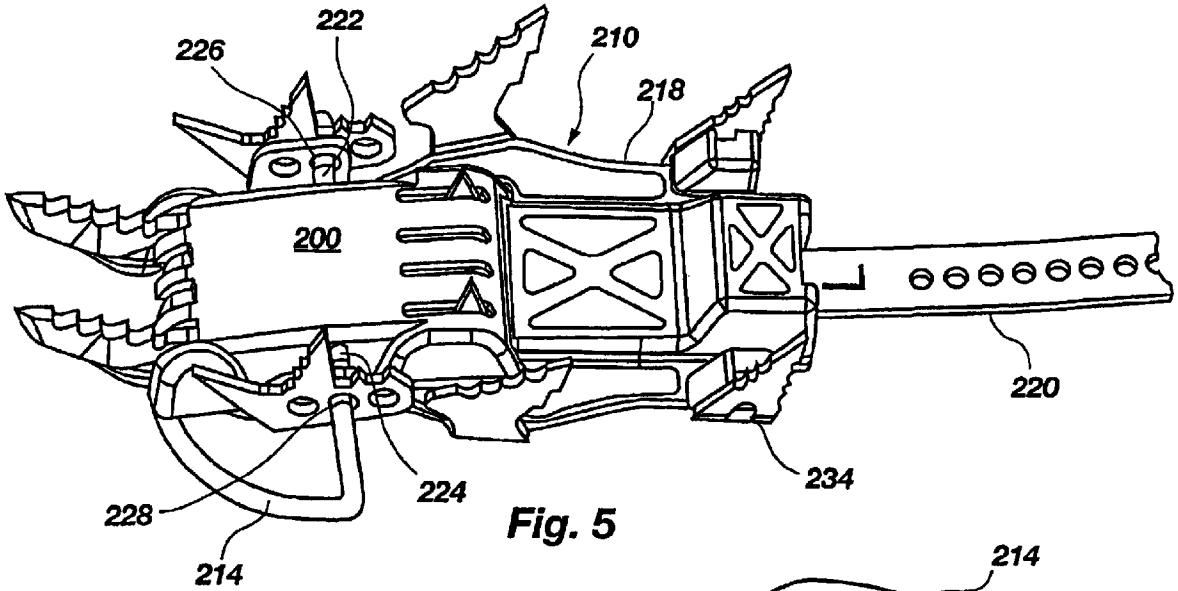
FIG. 5 is a bottom perspective view of another anti-balling plate attached to a front rail of a crampon.
Figure 6:
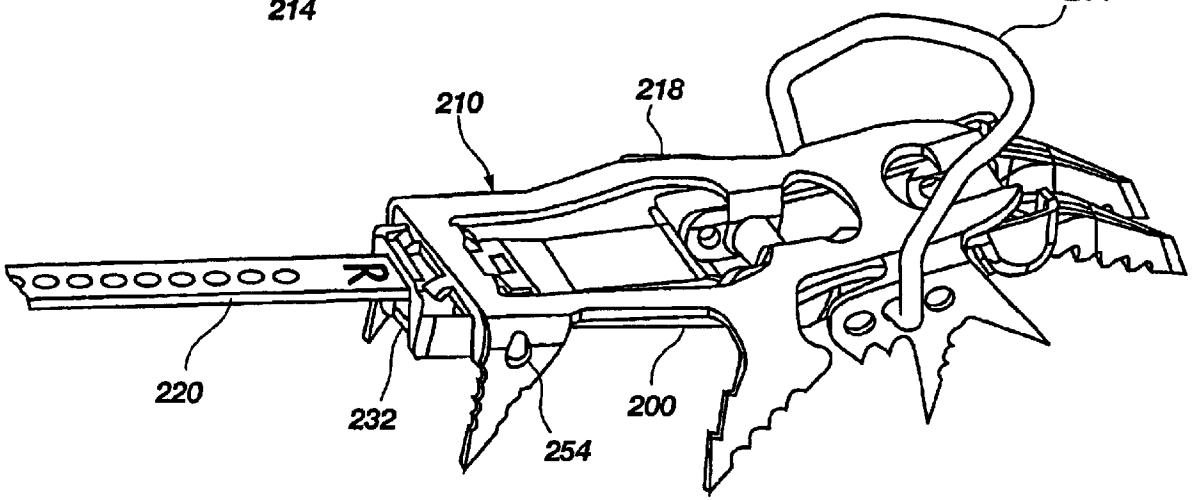
FIG. 6 is a top perspective view of the anti-balling plate attached to the front rail of the crampon of FIG. 5.
Figure 7:
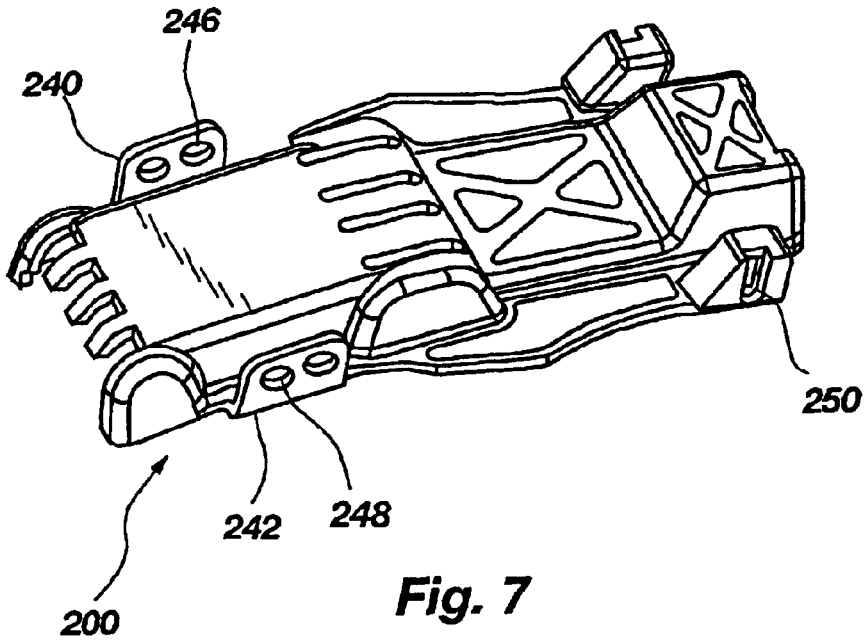
FIG. 7 is a bottom perspective view of the anti-balling plate of FIG. 5.
Figure 8:
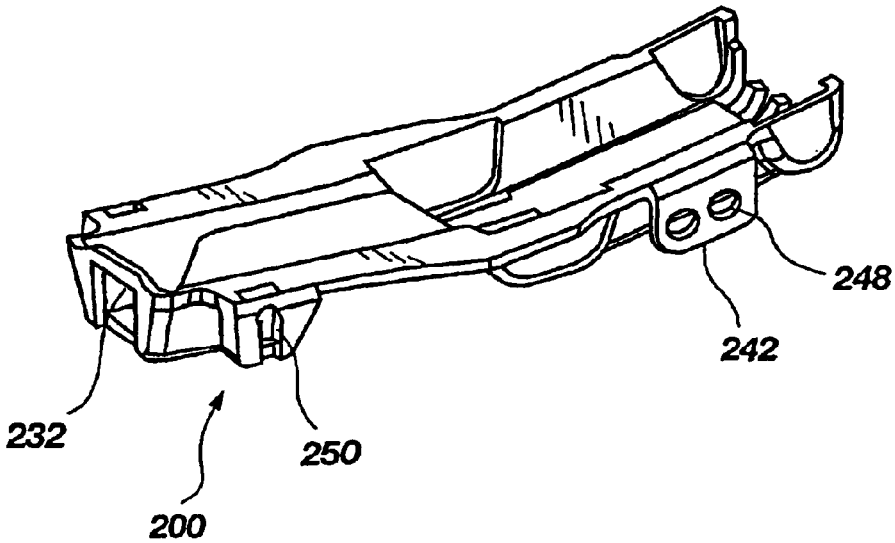
FIG. 8 is a top perspective view of the anti-balling plate of FIG. 5.

Referring to FIG. 2, the anti-balling system of the present invention may include a front plate 46 attached to the front rail 14 of the crampon 10. In addition, the anti-balling system of the present invention may include a rear plate 50 attached to the rear rail 18, as shown in FIGS. 3 and 4. It is, of course, understood that the front and rear plates 46 and 50 may be formed as a single unitary plate.

Referring to FIGS. 2–4, the front and rear plates 46 and 50 have lower surfaces 54 and 58, respectively. The lower surfaces 54 and 58, and the front and rear plates 46 and 50, are formed of a nonstick material which prevents snow and/or ice from sticking to the plates and accumulating beneath the crampon 10 and between the points 30. The material may be a thermoplastic such as a nylon or a polyethylene. Therefore, the plates 46 and 50 advantageously prevent snow and/or ice from sticking to the bottom of the crampon 10 and accumulating between the points 30.

Referring again to FIG. 2, the front plate 46 preferably is sized and shaped to match the size and shape of the front rail 14. Thus, the front plate 46 has a surface area which matches or nearly matches the bottom surface area of the front rail 14 to prevent snow from sticking to the bottom of the crampon. The front of the plate 46 preferably has a pair of loops 62 integrally formed therein. Thus, the plates 46 can be easily and inexpensively manufactured, such as with common injection molding techniques. The loops 62 preferably extend upwardly and are sized and shaped to receive the front points 38 of the crampon 10 therethrough. Therefore, the loops 62 advantageously secure the front of the front plate 46 to the front points 38 of the crampon 10.

In addition, the rear of the front plate 46 preferably has apertures 66 formed therein. The apertures 66 are located and positioned to align with apertures 70 formed in the side points 34 of the crampon 10. Thus, a fastener 74, such as a rivet, screw or bolt, may be inserted through the aperture 70 of the crampon 10 and into the aperture 66 of the plate 46 to further secure the plate 46 to the crampon 10.

The plates 46 and 50 preferably are removably attachable to the crampon 10. Thus, the front crampon 46 may be attached to the front rail 14 by sliding the front points 38 through the loops 62 and locating the front plate 46 underneath the front rail 14. The aperture 66 of the plate 46 may be aligned with the aperture 70 in the side rails 34, and fastener 74 inserted therethrough. Therefore, the anti-balling plate 46 may be quickly and easily attached and removed to the crampon 10.

Additional tabs 78 may also be formed on the crampon to form additional attachment points to the plate 46. Cavities 82 may be formed in the plate 46 to receive a nut 84 in a nonrotational manner, such that a bolt may be fastened thereto.

Referring to FIGS. 3 and 4, the rear plate 50 is similar in many respects to the front plate 46. The rear plate 50 may also have apertures 88 formed therein to align with apertures 92 in the rear points 42 of the crampon 10. A fastener may be inserted through the aperture 92 in the rear points 42 and into the aperture 88 in the rear plate 50 to attach the rear plate to the rear rail 18. In addition, a loop 96 may be formed on the upper side of the rear plate 50 forming an aperture to receive the center strap 22 (FIG. 1) therethrough to further attach the rear plate 50 the crampon 10. In one aspect, the loop 96 is integrally formed with the plate 50.

Referring again to FIG. 2, the lower surface 54 of the plate 46 may include a plurality of protrusions 100 forming a plurality of raised sections 104. The plurality of protrusions and raised sections 100 and 104 provide a plurality of edges 108 configured to prevent the lower surface 54 from sliding or skidding along another object, and thus providing a nonskid surface. It will be appreciated that the climber may position the crampon over a sharp or narrow rock or ice which may contact only the bottom of the crampon and not the points. Thus, the plate 14 may slide or skid along the ice or rock, causing the climber to lose his or her balance. Thus, the protrusions 104 and edges 108 advantageously prevent the plates 14 or lower surface 54 from sliding or skidding along another object.

In addition, the plurality of sections 104 may be formed of a material different from the material of the plate 46. The sections 104 may form a nonskid surface formed from a nonskid material such as a thermoplastic elastomer, or a thermoplastic urethane. Thus, the lower surface of the sections 104 themselves resist sliding or skidding. The rear plate 50 may have a similar configuration. The rear crampon 50 is preferably sized and shaped to match the size and shape of the rear rail 18, and preferably has a surface area sized to extend over all or a majority of the rear rail 14.

As indicated above, the front and rear plates 46 and 50 may form a single plate extending along the entire length of the crampon. The plates 46 and 50 advantageously may be inexpensively and easily manufactured, such as with common injection molding techniques. The plates 46 and 50 of the present invention advantageously reduce the number of fasteners required to attach the plates to the crampon. In addition, the plates may be easily attached and removed. In addition, the plates are securely attached to the crampon, and do not come off unless broken. In addition, the rigidity of the plates helps the plates stay secured to the crampon, and can remain on the crampon even if a portion fails or breaks.

Referring again to FIG. 2, the loops 62 formed around the front points 38 may advantageously prevent snow or ice from accumulating or balling around the front points 38. In addition, a portion 112 of the front plate may extend up and around the front of the front rail 14 to prevent snow accumulation.

Referring to FIGS. 5–8, another anti-balling plate 200 is shown which is similar in many respects to those described above. The plate 200 is configured for use with a crampon 210 having a bail or bail wire 214 for attaching a user's boot to the crampon 210. Only a front rail 218 of the crampon 210 is shown, and the bail 214 is a front or forefoot bail for attaching the user's forefoot to the crampon. It is of course understood that a rear rail and rear or heel bail has a similar configuration. The crampon 210 has a center strap 220 to couple the front and rear rails.

The bail 214 is a loop of wire bent into a desired configuration and extending over the crampon 210 into which the user's boot is received. The bail 214 has opposite ends 222 and 224 which extend through holes 226 and 228 in the crampon 210 or points. It will be appreciated that the bail 214 is resilient and can be flexed outwardly to withdraw the ends 222 and/or 224 from the respective holes 226 and/or 228, but that the ends are biased into the holes to maintain the bail on the crampon.

The plate 200 advantageously can be attached to the crampon 210 with only the structure of the crampon 210 itself. A front of the plate 200 is attached to the crampon 210 by the bail 214, or ends 222 and 224 thereof, while a rear of the plate 200 is attached to the crampon 210 by the center strap 220. The plate 200, or flange thereof, is received between the crampon 210 and the ends 222 and 224 of the bail 214. A loop or window 232 can be formed in the rear of the plate 200 to receive the center strap 220 therethrough.

To attach the plate 200 to the crampon 210, the plate 200 is positioned adjacent the bottom of the crampon 210. The ends 222 and/or 224 of the bail 214 can be displaced outwardly to allow the plate 200 to be positioned adjacent the crampon. For example, the bail 214 can be removed. The bail 214 can be replaced, or the ends 222 and 224 reinserted through the holes 226 and 228. Thus, the plate 200, or flange thereof, is disposed between the ends 222 and 224 of the bail 214 and the bottom of the crampon 210.

The center strap 220 is received through the loop or window 232 in the plate 200. The center strap 220 also can be removed from the front rail 218, or the plate 200 can be inserted over the center strap 220. Thus, the plate 200 is secured to the crampon 210 with the structure of the crampon itself, namely the bail 214 and center strap 220. The front of the plate 200 is secured with the bail 214, while the rear of the plate is secured with the center strap 220.

In addition, the plate 200 can have flanges 240 and 242 with apertures 246 and 248 to receive the ends 222 and 224 of the bail 214. The flanges 240 and 242 can extend along the crampon 210 or points at the holes 226 and 228.

In addition, the plate 200 can have additional holes or pockets 250 to receive additional fasteners, such as screws or bolts. The pockets 250 can be configured to hold a nut in a non-rotational manner such that a bolt can be received therethrough and engage the nut in an operational manner. Corresponding holes 254 can be formed in the crampon 210. As shown, a total of seven connections can be made for the front crampon.

It is of course understood that a similar connection can be made with a rear plate and a rear rail of the crampon using a rear or heel bail.

In addition, it is understood that the plate can be attached in any of the ways described above, such as looping around points, looping around the center strap, held by a bail, fasteners through holes, or combination of the above.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. An anti-balling system configured to be used with a crampon to prevent balling and snow accumulation during snow and ice climbing, the system comprising:

a) a plate, attached to the bottom of the crampon, having a lower surface formed of a thermoplastic material configured to prevent sticking of snow or ice to the lower surface of the plate, and thus to the crampon; and b) the plate further including at least one loop integrally formed at a front of the plate configured to receive a front point of the crampon to attach the plate to the crampon.

2. A system in accordance with claim 1, wherein the lower surface of the plate further includes a plurality of protrusions extending therefrom forming a plurality of raised sections and a plurality of edges forming a nonskid surface configured to prevent the lower surface of the plate from sliding with respect to another object.

3. A system in accordance with claim 1, wherein the plate is configured to be removably attachable to the crampon.

4. A system in accordance with claim 1, wherein the plate is rigid.

5. An anti-balling system configured to be used with a crampon to prevent balling and snow accumulation and to prevent sliding or skidding during snow and ice climbing, the system comprising:

a) a plate, attached to the bottom of the crampon, having a lower surface formed of a thermoplastic material configured to prevent sticking of snow or ice to the lower surface of the plate, and thus to the crampon; and b) a plurality of raised sections, formed on the lower surface of the plate and extending therefrom, formed of a thermoplastic elastomer or urethane material different from the thermoplastic material of the plate forming a nonskid surface configured to prevent the lower surface of the plate from sliding with respect to another object.

6. A system in accordance with claim 5, wherein the lower surface of the plate further includes a plurality of protrusions extending therefrom forming the plurality of raised sections and a plurality of edges forming the nonskid surface configured to prevent the lower surface of the plate from sliding with respect to another object.

7. A device in accordance with claim 5, wherein the plate is configured to be removably attachable to the crampon.

8. A system in accordance with claim 5, wherein the plate is rigid.

9. An anti-balling system configured to be used with a crampon to prevent balling and snow accumulation during snow and ice climbing, the system comprising:

a) a crampon having a bottom and a plurality of points extending downwardly therefrom to form an interior space, including at least one front point extending generally downwardly and forwardly;

b) a plate, attached to the bottom of the crampon, having a lower surface formed of a thermoplastic material configured to prevent sticking of snow or ice to the lower surface of the plate, and thus to the crampon; and c) the plate further including at least one loop integrally formed at a front of the plate and receiving the at least one front point of the crampon to attach the plate to the crampon.

10. A system in accordance with claim 9, wherein the crampon further includes side points on either thereof, the side points each including an aperture therethrough; and wherein the plate further includes apertures on either side thereof located to align with the apertures of the side points; and further comprising fasteners extending through the apertures in the side points and the apertures in the plates to attach the plate to the crampon.

11. A system in accordance with claim 9, wherein the lower surface of the plate further includes a plurality of protrusions extending therefrom forming a plurality of raised sections and a plurality of edges forming a nonskid surface configured to prevent the lower surface of the plate from sliding with respect to another object.

12. A system in accordance with claim 9, further comprising:

a plurality of sections, formed on the lower surface of the plate, formed of a material different from the material of the plate forming a nonskid surface configured to prevent the lower surface of the plate from sliding with respect to another object.

13. A system in accordance with claim 9, further comprising:

a plurality of raised sections, formed on the lower surface of the plate and extending therefrom, formed of a thermoplastic elastomer or urethane material different from the thermoplastic material of the plate forming a nonskid surface configured to prevent the lower surface of the plate from sliding with respect to another object.

14. A system in accordance with claim 9, wherein the plate is removably attachable to the crampon.

15. A system in accordance with claim 9, wherein the plate is rigid.

16. A method for attaching an anti-balling plate to a crampon, the method comprising the steps of:

a) providing a crampon having a bottom and a plurality of points extending downwardly therefrom to form an interior space, including at least one front point extending generally downwardly and forwardly, and side points each having an aperture extending therethrough;

b) providing an anti-balling plate having a lower surface formed of a thermoplastic material configured to prevent sticking of snow or ice to the lower surface of the plate, and thus to the crampon, and having at least one loop integrally formed at a front of the plate and apertures formed in sides thereof;

c) positioning the plate at the bottom of the crampon and sliding the at least one front point of the crampon through the at least one loop of the plate to secure the front of the plate to the front of the crampon;

d) aligning the apertures of the plate with the apertures of the side points; and e) securing the sides of the plate to the sides of the crampon by inserting fasteners through the apertures in the side points and the apertures in the plate.

17. A method in accordance with claim 16, further comprising:

removing the plate from the crampon by removing the fasteners and sliding the front point back out of the loop.

18. An anti-balling system configured to be used with a crampon to prevent balling and snow accumulation during snow and ice climbing, the system comprising:

a) a crampon having a bottom and a plurality of points extending downwardly therefrom to form an interior space;

b) a rigid plate, attached to the bottom of the crampon, having a lower surface formed of a material configured to prevent sticking of snow or ice to the lower surface of the plate, and thus to the crampon; and c) a bail, attached to the crampon, to secure a user's boot to the crampon, and having an end portion to secure the plate to the crampon.

19. A system in accordance with claim 18, wherein the crampon further has a center strap connecting front and rear rails; and wherein the plate further includes a loop to receive the center strap therethrough to further attach the plate to the crampon.

20. A system in accordance with claim 18, wherein the plate is formed of a thermoplastic material.

21. A method for attaching an anti-balling plate to a crampon, the method comprising the steps of:

a) providing a crampon having a bottom and a plurality of points extending downwardly therefrom to form an interior space, and having a bail attached thereto to secure a user's boot to the crampon;

b) providing an anti-balling plate having a lower surface formed of a material configured to prevent sticking of snow or ice to the lower surface of the plate, and thus to the crampon;

c) positioning the plate at the bottom of the crampon; and d) securing the plate between the crampon and an end portion of the bail.

22. A method in accordance with claim 21, wherein the crampon includes a center strap connecting front and rear rails; and wherein the plate has at least one loop to receive the center strap therethrough; and further comprising the step of:

sliding the center strap of the crampon through the at least one loop of the plate to secure the plate to the crampon.

23. An anti-balling system configured to be used with a crampon to prevent balling and snow accumulation and to prevent sliding or skidding during snow and ice climbing, the system comprising:

a) a plate, attached to the bottom of the crampon, having a lower surface formed of a thermoplastic material configured to prevent sticking of snow or ice to the lower surface of the plate, and thus to the crampon; and b) at least a portion of the lower surface of the plate being formed of a thermoplastic elastomer or urethane material different from the thermoplastic material of the plate forming a nonskid surface.

* * * * *